US006951457B2

(12) United States Patent
Li

(10) Patent No.: US 6,951,457 B2
(45) Date of Patent: Oct. 4, 2005

(54) SAFETY LIGHTER

(75) Inventor: Kin Chung Li, Hacienda Heights, CA (US)

(73) Assignee: Prime GIL Intel, Inc., Hacienda Heights, CA (US)

( * ) Notice: Subject to any disclaimer, the term of this patent is extended or adjusted under 35 U.S.C. 154(b) by 0 days.

(21) Appl. No.: 10/724,464

(22) Filed: Dec. 1, 2003

(65) Prior Publication Data

US 2005/0118547 A1 Jun. 2, 2005

(51) Int. Cl.[7] ..... F23Q 1/02
(52) U.S. Cl. ..... 431/254
(58) Field of Search ..... 431/344, 277, 431/254; 220/581, 582, 801, 789; 215/321, 43, 45

(56) References Cited

U.S. PATENT DOCUMENTS 2,618,952 A * 11/1952 Peterson et al. ..... 431/344
3,141,317 A * 7/1964 Segawa ..... 431/254
3,792,963 A * 2/1974 Tricot ..... 431/277
3,895,904 A * 7/1975 Kimball ..... 431/254
4,201,537 A * 5/1980 Nitta ..... 431/344
5,439,375 A * 8/1995 Wang ..... 431/277

FOREIGN PATENT DOCUMENTS

EP 313428 A1 * 4/1989 ..... 431/344

* cited by examiner

*Primary Examiner*—Stephen Gravini
(74) *Attorney, Agent, or Firm*—Raymond Y. Chan; David and Raymond

(57) ABSTRACT

A safety lighter includes a lighter body comprising a casing defining a liquefied gas chamber for containing a predetermined volume of liquefied gas therein, a supporting frame having an outer sealing surface engaged with an inner surface of the casing, a gas emitting nozzle mounted on the supporting frame to communicate with the liquefied gas chamber, and an ignition device supported by the supporting frame for ignition. A sealing arrangement includes upper and lower sealing rims spacedly and integrally provided along an opening portion of the inner surface of the casing in a step-shouldering manner wherein the upper and lower sealing rims are sealed with the outer sealing surface of the supporting frame to form two sealing lines along the upper and lower sealing rims respectively to sealedly mount the supporting frame on the lighter body for sealedly retaining the liquefied gas within the liquefied gas chamber.

16 Claims, 5 Drawing Sheets

SAFETY LIGHTER

BACKGROUND OF THE PRESENT INVENTION

1. Field of Invention

The present invention relates to a lighter, and more particularly to a safety lighter, which comprises a safety arrangement to sealedly mount the supporting frame to the casing for sealedly retaining the liquefied gas therein so as to prevent not only the leakage of the liquefied gas but also the explosive damages of the lighter due to the temperature and the external pressure.

2. Description of Related Arts

Modern butane lighters, such as flint-type lighters or piezoelectric lighters, have become very popular since the lighters are economy, cheap, and easy operation. As shown in FIG. 1, a conventional butane lighter comprises a casing having a liquefied gas chamber, a supporting frame sealedly supported on the casing, a gas emitting nozzle sealedly mounted on the supporting frame to communicate with the liquefied gas chamber, and an ignition device mounted on the supporting frame to generate a spark for ignition. However, such conventional butane lighter has several drawbacks.

In order to seal the supporting frame on the casing, the supporting frame has a sealing edge to seal with an inner surface of the casing to form a sealing line L so as to retain the liquefied gas within the liquefied gas chamber. However, the sealing line L may be broken since the liquefied gas within the casing is sensitive to the temperature, external pressure, and impact. In other words, when any portion of the sealing line L is broken, the liquefied gas may leak or even be vaporized and exploded. For example, when the butane lighter is placed on the dashboard of the vehicle which is parked outdoors, the sunlight will heat up the liquefied gas to vaporize that largely increases the gas pressure in the gas chamber. Generally, the casing is made to withstand the temperature of the liquefied gas below 55°.

In addition, when the liquefied gas is released to the gas emitting nozzle, the impulsive pressure by the phase change of the liquefied gas from liquid to gas is substantially applied to the supporting frame. The impulsive pressure of the liquefied gas substantially pushes the supporting frame upwardly so as to break the sealing line L between the supporting frame and the casing.

Furthermore, the butane lighter further comprises a sealing ring R mounted around the gas emitting nozzle to sealedly mount the gas emitting nozzle on the supporting frame so as to prevent the liquefied gas from leaking through the gap between the gas emitting nozzle and the supporting frame. However, in order to keep the butane lighter in low cost, a common the sealing ring R may be used that the liquefied gas may start leaking after using a period of time. Of course, a very good quality and expensive sealing ring R can be used to extend the service life of the butane lighter but the cost and precise installation of the sealing ring R will largely increase the manufacturing cost of the butane lighter.

SUMMARY OF THE PRESENT INVENTION

A main object of the present invention is to provide a safety lighter which comprises a safety arrangement to sealedly mount the supporting frame to the casing for sealedly retaining the liquefied gas therein so as to prevent not only the leakage of the liquefied gas but also the explosive damages of the lighter due to the temperature, the external pressure, and impact.

Another object of the present invention is to provide a safety lighter, wherein the casing has two sealing rims to connect with an outer surface of the supporting frame to form two sealing lines for substantially sealing the supporting frame to the casing so as to strengthen the sealing connection therebetween.

Another object of the present invention is to provide a safety lighter, wherein the inner surface of the supporting frame is extended inclinedly to physically contact with the sealing rims such that no precise configuration of the supporting frame is required to fittingly engage with the casing so as to minimize the manufacturing cost of the safety lighter of the present invention.

Another object of the present invention is to provide a safety lighter, wherein the supporting frame comprises a reinforcing member extended downwardly towards the liquefied gas chamber to strengthen the supporting frame by evenly distributing the internal pressure of the liquefied gas so as to reinforce the casing.

Another object of the present invention is to provide a safety lighter, wherein the gas emitting nozzle has two or more sealing rings spacedly mounted therearound to sealedly mount the gas emitting nozzle on the supporting frame, so as to prevent the liquefied gas from leaking through the gap between the gas emitting nozzle and the supporting frame.

Another object of the present invention is to provide a safety lighter, wherein the safety arrangement can be incorporated with any type of ignition device, such as flint-type ignition device or piezoelectric-type ignition device, to prevent the leakage of the liquefied gas.

Another object of the present invention is to provide a safety lighter, wherein no expensive or complicated mechanical structure is required to employ in the present invention in order to achieve the above mentioned objects. Therefore, the present invention successfully provides an economic and efficient solution for providing a secure sealing arrangement to prevent the leakage of the liquefied gas while being cost effective.

Accordingly, in order to accomplish the above objects, the present invention provides a safety lighter, comprising:

a lighter body comprising a casing defining a liquefied gas chamber for containing a predetermined volume of liquefied gas therein;

a supporting frame having an outer sealing surface engaged with an inner surface of the casing;

a gas emitting nozzle mounted on the supporting frame to communicate with the liquefied gas chamber for emitting the gas from the liquefied gas chamber in a controlled manner;

an ignition device supported by the supporting frame for igniting the gas emitting from the gas emitting nozzle; and a sealing arrangement comprising upper and lower sealing rims spacedly and integrally provided along an opening portion of the inner surface of the casing in a step-shouldering manner wherein the upper and lower sealing rims are sealed with the outer sealing surface of the supporting frame to form two sealing lines along the upper and lower sealing rims respectively to sealedly mount the supporting frame on the lighter body for sealedly retaining the liquefied gas within the liquefied gas chamber.

These and other objectives, features, and advantages of the present invention will become apparent from the following detailed description, the accompanying drawings, and the appended claims.

DETAILED DESCRIPTION OF THE PREFERRED EMBODIMENT

Figure 1:
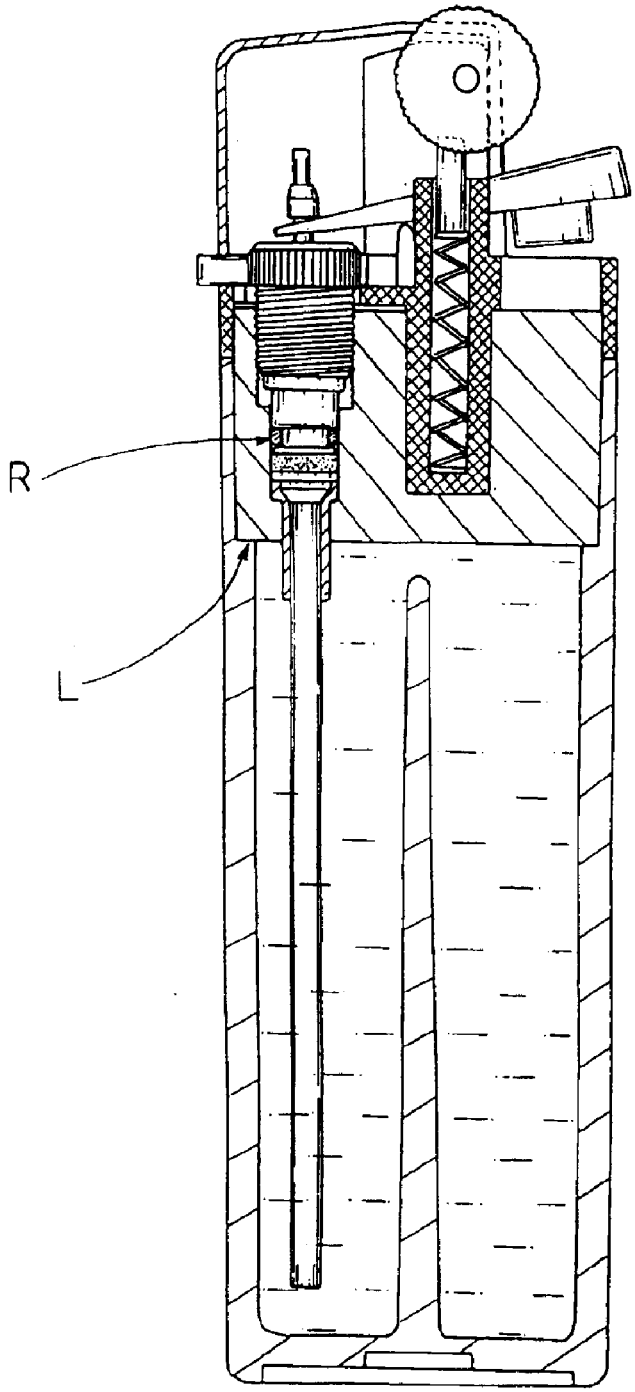
FIG. 1 PRIOR ART
FIG. 1 is a partially sectional view of a conventional butane lighter.
Figure 2:
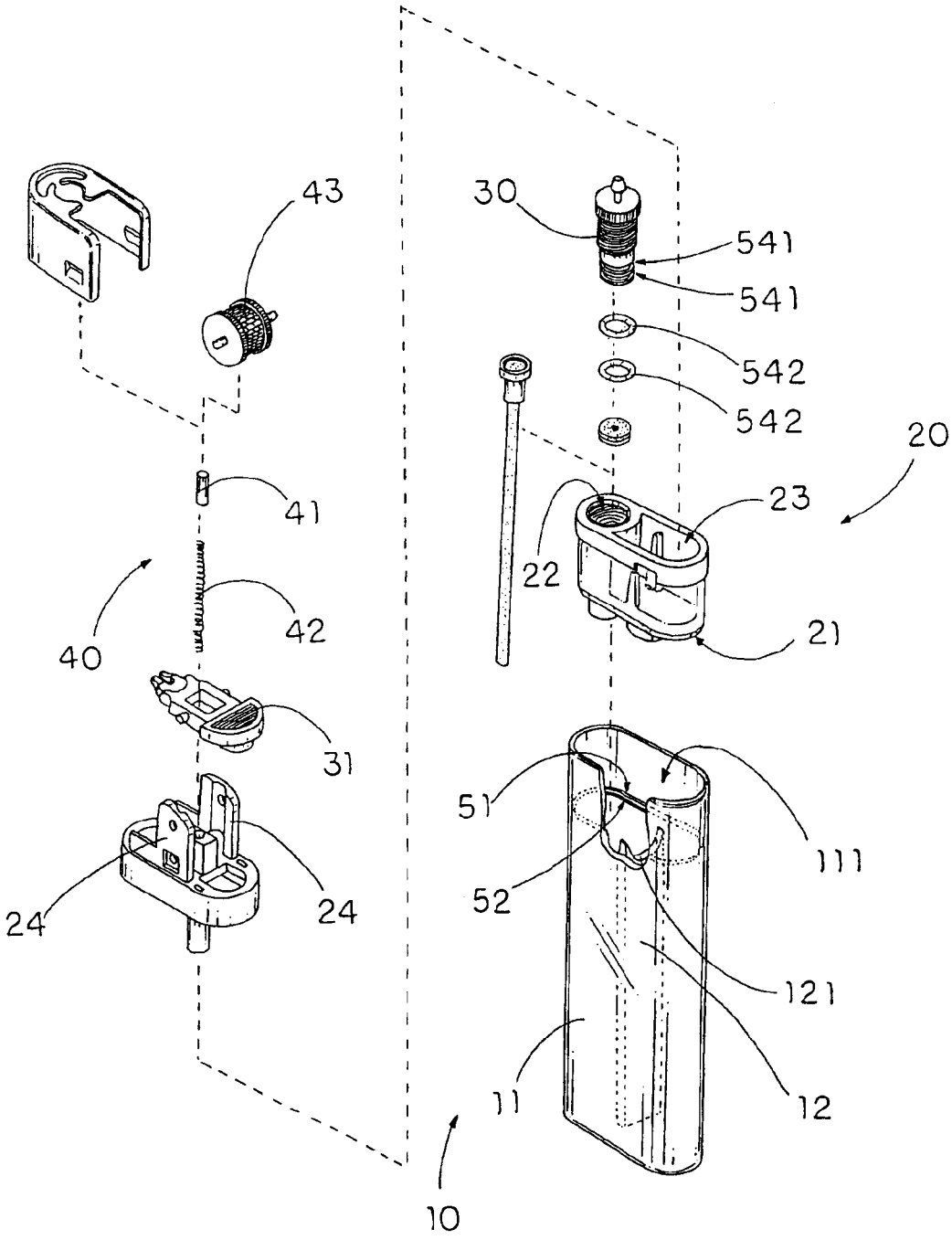
FIG. 2 is an exploded perspective view of a safety lighter according to a preferred embodiment of the present invention.
Figure 3:
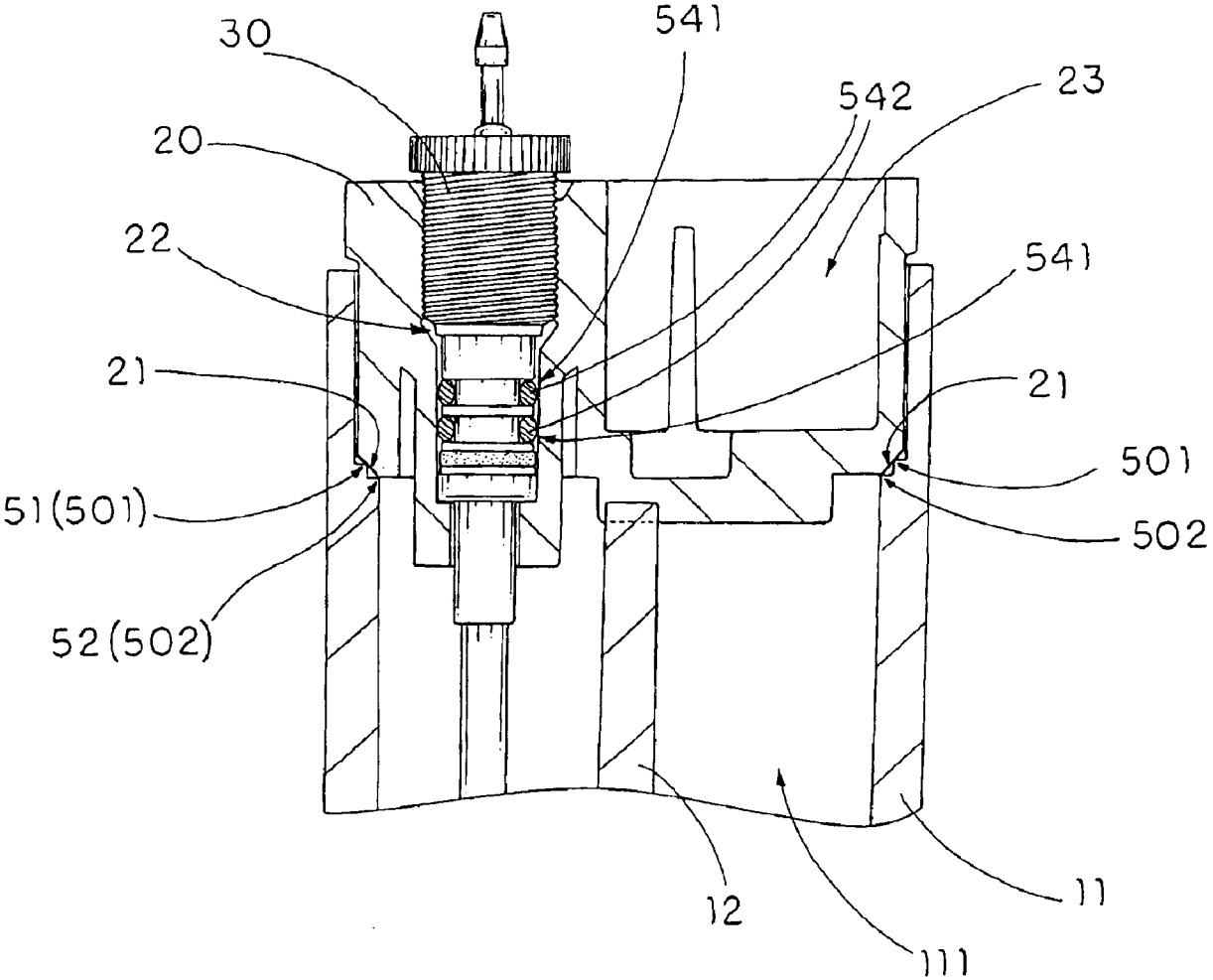
FIG. 3 is a partially side sectional view of the safety lighter according to the above preferred embodiment of the present invention.

Referring to FIGS. 2 and 3 of the drawings, a safety lighter according to a preferred embodiment of the present invention is illustrated, wherein the safety lighter, which is embodied as a flint-type lighter, comprises a lighter body 10 comprising a casing 11 defining a liquefied gas chamber 111 for containing a predetermined volume of liquefied gas therein, and a supporting frame 20 having an outer slanted sealing surface 21 engaged with an inner surface of the casing 11.

The safety lighter further comprises a gas emitting nozzle 30 mounted on the supporting frame 20 to communicate with the liquefied gas chamber 111 for emitting the gas from the liquefied gas chamber 111 in a controlled manner, and an ignition device 40 supported by the supporting frame 20 for igniting the gas from the gas emitting nozzle 30.

The safety lighter further comprises a sealing arrangement 50 comprising upper and lower sealing rims 51, 52, which are continuous step-shoulders, spacedly and integrally formed along an opening portion of the inner surface of the casing 11. The upper and lower sealing rims 51, 52 are sealed with the outer sealing surface 21 of the supporting frame 20 to form two sealing lines 501, 502 along the upper and lower sealing rims 51, 52 respectively to sealedly mount the supporting frame 20 on the lighter body 10 for sealedly retaining the liquefied gas within the liquefied gas chamber 111.

According to the preferred embodiment, the lighter body 10 further comprises a reinforcing wall 12 affixed between the two inner walls of the casing 11 within the liquefied gas chamber 111 to divide the liquefied gas chamber 111 into two compartments, wherein the reinforcing wall 12 is upwardly extended from a bottom wall of the casing 11 towards the opening portion thereof to define a communication cavity 13 between a top edge 121 of the reinforcing wall 12 and a bottom side of the supporting frame 20 when the supporting frame 20 is mounted on the casing 11 such that the two compartments are communicated with each other through communication cavity 13.

The supporting frame 20 further has a nozzle cavity 22 to receive the gas, emitting nozzle 30 therewithin and an ignition cavity 23 to receive the ignition device 40 therein. The supporting frame 20 further comprises two supporting walls 24 parallelly and upwardly extended to pivotally support a gas lever 31 to control a flow of the liquefied gas through the gas emitting nozzle 30.

The ignition device 40 comprises a flint 41 supported by a resilient element 42 and a striker wheel 43 wherein the flint 41 and the resilient element 42 are received in a flint housing provided between the two supporting walls 24 of the supporting frame 20. The striker wheel 43 is rotatably mounted between the two supporting walls 24 wherein the flint 41 is supported by the resilient element 42 to upwardly urge against the striker wheel 43 such that the striker wheel 43 is driven to rotate to generate a spark towards the gas emitting nozzle 20 ignite the gas emitted from the gas emitting nozzle 30 at the same time.

As shown in FIG. 3, each of the upper and lower sealing rims 51, 52 is integrally formed around the opening portion of the inner surface of the casing 11 in a step-shoulders shape by physically reducing the thickness of the opening portion of the casing 11. In other words, a circumferential size of the upper sealing rim 51 is larger than that of the lower sealing rim 52.

According to the preferred embodiment, the outer sealing surface 21 of the supporting frame 20 is an inclined surface that substantially attaches with the upper and lower sealing rims 51, 52 at the same time, so that when the supporting frame 20 is inserted into the opening portion of the casing 11, the outer sealing surface 21 of the supporting frame 20 is substantially contacted with both the upper and lower sealing rims 51, 52 to form the two sealing lines 501, 502 respectively by ultrasonic for example.

It is worth to mention that the outer sealing surface 21 of the supporting frame 20 can alternatively be constructed to have a corresponding step-shouldering shape to fittingly match with the step-shoulders of the upper and lower rims 51, 52. However, the supporting frame 20 must be precisely manufactured to form the step-shouldering shaped outer sealing surface 21 to sealedly attach with the upper and lower rims 51, 52, which would increase the manufacturing cost of the lighter. Therefore, the slanted outer sealing surface 21 of the supporting frame 20 is constructed to physically engage the upper and lower rims 51, 52 at the same time for simplifying the configuration of the supporting frame 20 to seal with the lighter body 10 so as to lower the manufacturing cost of the safety lighter.

Figure 4:
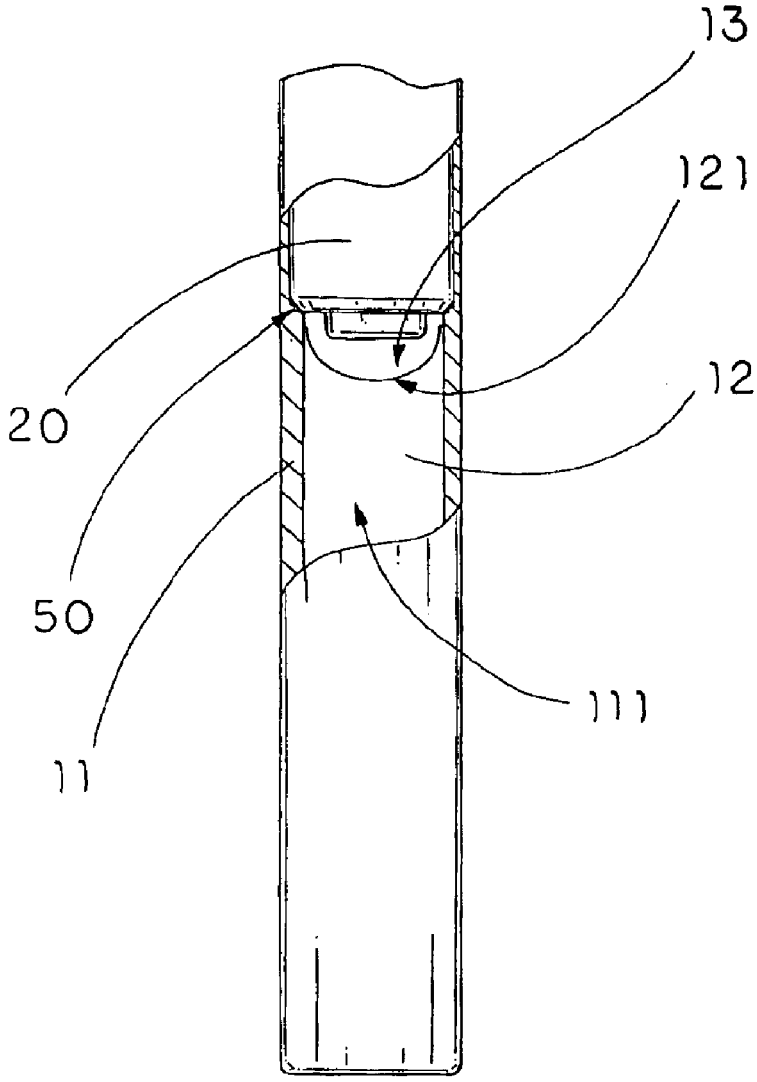
FIG. 4 is a partially front sectional view of the safety lighter according to the above preferred embodiment of the present invention.

As shown in FIG. 4, the top edge 121 of the reinforcing wall 12 having a U-shaped is formed between two inner walls of the casing 11 within the communication cavity 13 so as to strengthen the casing 11 at the communication cavity 13.

It is worth to mention that the liquefied gas within the liquefied gas chamber 111 applies a relatively high pressure against the inner walls of the casing 11 such that the reinforcing wall 12 is required to strengthen the casing 11 to prevent the leakage of the liquefied gas due to the internal pressure. Due to the limited thickness of each inner walls of the casing 11 at the communication cavity 13, the internal pressure of the liquefied gas may break the casing 11 at the communication cavity 13. Therefore, the U-shaped top edge 121 of the reinforcing wall 12 is extended within the communication cavity 13 to reinforce the casing 11 to prevent the breakage of the casing 11 by the internal pressure. In other words, two sides of the top edge 121 of the reinforcing wall 12 are upwardly extended on the inner walls of the casing 11 towards the lower sealing rim 52 to increase the thickness of the casing 11 at the communication cavity 13. Therefore, the thickness of the casing 11 can be substantially increased at the communication cavity 13 in comparison with the conventional butane lighter to rigidly strengthen the casing 11 of the lighter body 10 of the present invention.

The sealing arrangement 50 further has two holding grooves 541 spacedly provided around the gas emitting nozzle 30 and two sealing rings 542 respectively received at the two holding grooves 541 to sealedly mount the gas emitting nozzle 30 on the supporting frame 20. As shown in FIG. 3, the two sealing rings 542 are spacedly and coaxially mounted around the gas emitting nozzle 20 wherein each of the sealing rings 542 is sealedly sandwiched between an outer circumferential wall of the gas emitting nozzle 30 and an inner circumferential wall of the nozzle cavity 22 of the supporting frame 20 so as to sealedly mount the gas emitting nozzle 30 on the supporting frame 20. It is worth to mention that the two sealing rings 542 function as two gas leaking barriers to prevent the liquefied gas from leaking between a connection between the gas emitting nozzle 30 and the supporting frame 20 through the nozzle cavity 22. In addition, since the two sealing rings 542 are used as a double-safety configuration, no matter what kind of sealing ring is used, the sealing effect will be largely increased. Even though a specific circumferential portion of one of the sealing rings 542 is worn out to start leaking the gas, there still have no gas leakage of the lighter unless the corresponding circumferential portion of another sealing ring 542 is leaked or worn out too. In other words, the gas in the lighter of the present invention may leaked unless the two corresponding circumferential portions of the sealing rings 542, which must be aligned with each other, are worn out at the same time.

Figure 5:
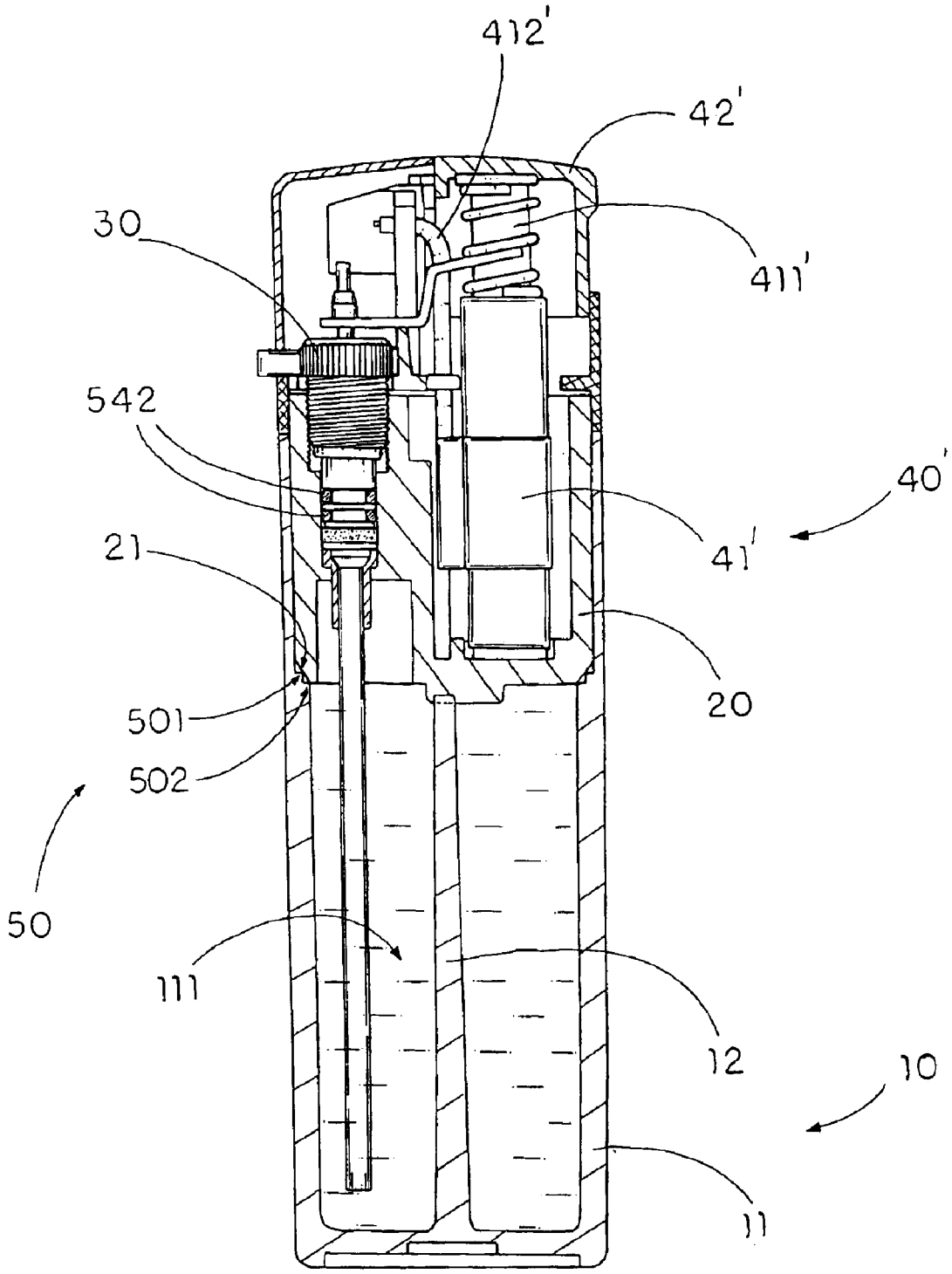
FIG. 5 illustrates the safety lighter incorporating with a piezoelectric ignition device according to the above preferred embodiment of the present invention.

FIG. 5 illustrates the sealing arrangement 50 incorporating with a piezoelectric lighter. As shown in FIG. 4, the ignition device 40' comprises a piezoelectric unit 41' disposed in the lighter body 10 for generating piezoelectricity wherein the piezoelectric unit 41' comprises a movable operating part 411' extended upwardly and an ignition tip 412' extended to a position close to the gas emitting nozzle 30 in such a manner that when the movable operating part 411' is depressed downwardly via an ignition button 42', the ignition tip 412' generates sparks to ignite the liquefied gas emitted from the gas emitting nozzle 30 at the same time. In other words, the sealing arrangement 50 is adapted to incorporate with both flint-type ignition device 40 and piezoelectric-type ignition device 40' to prevent the liquefied gas leaking from the lighter body 10.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following

What is claimed is:

1. A safety lighter, comprising:

a lighter body comprising a casing defining a liquefied gas chamber for containing a predetermined volume of liquefied gas therein;

a supporting frame having an outer sealing surface sealedly attached with an inner surface of said casing;

a gas emitting nozzle mounted on said supporting frame to communicate with said liquefied gas chamber for emitting said gas from said liquefied gas chamber in a controlled manner;

an ignition device supported by said supporting frame for igniting said gas emitted from said gas emitting nozzle; and a sealing arrangement comprising upper and lower sealing rims spacedly and integrally provided along an opening portion of said inner surface of said casing in a continuous step-shoulders shape wherein said upper and lower sealing rims are sealedly attached with said outer sealing surface of said supporting frame to form two sealing lines along said upper and lower sealing rims respectively to sealedly mount said supporting frame on said lighter body for sealedly retaining said liquefied gas within said liquefied gas chamber, wherein said outer sealing surface of said supporting frame is an inclined surface that substantially attaches with said upper and lower sealing rims at the same time to form said sealing lines respectively to sealedly mount said supporting frame on said lighter body.

2. The safety lighter, as recited in claim 1, wherein said lighter body further comprises a reinforcing wall affixed between two inner walls of said casing to divide said liquefied gas chamber into two compartments, wherein said reinforcing wall is upwardly extended towards said opening portion of said casing to define a communication cavity between said reinforcing wall and said supporting frame to communicate between said two compartments, wherein said reinforcing wall has a top edge having a U-shape formed between said two inner walls of said casing within said communication cavity to strengthen said casing at said communication cavity.

3. The safety lighter, as recited in claim 1, wherein two sides of said top edge of said reinforcing wall are upwardly extended along said two inner walls of said casing respectively towards said lower sealing rim to increase a thickness of said casing at said communication cavity.

4. A safety lighter, comprising:

a lighter body comprising a casing defining a liquefied gas chamber for containing a predetermined volume of liquefied gas therein;

a supporting frame having an outer sealing surface sealedly attached with an inner surface of said casing;

a gas emitting nozzle mounted on said supporting frame to communicate with said liquefied gas chamber for emitting said gas from said liquefied gas chamber in a controlled manner;

an ignition device supported by said supporting frame for igniting said gas emitted from said gas emitting nozzle; and a sealing arrangement comprising upper and lower sealing rims spacedly and integrally provided along an opening portion of said inner surface of said casing in a continuous step-shoulders shape wherein said upper and lower sealing rims are sealedly attached with said outer sealing surface of said supporting frame to form two sealing lines along said upper and lower sealing rims respectively to sealedly mount said supporting frame on said lighter body for sealedly retaining said liquefied gas within said liquefied gas chamber, wherein each of said upper and lower sealing rims is integrally formed around said opening portion of said inner surface of said casing in said step-shoulders shape by physically reducing a thickness of said opening portion of said casing, wherein said outer sealing surface of said supporting frame is an inclined surface that substantially attaches with said upper and lower sealing rims at the same time to form said sealing lines respectively to sealedly mount said supporting frame on said lighter body.

5. The safety lighter, as recited in claim 4, wherein said lighter body further comprises a reinforcing wall affixed between two inner walls of said casing to divide said liquefied gas chamber into two compartments, wherein said reinforcing wall is upwardly extended towards said opening portion of said casing to define a communication cavity between said reinforcing wall and said supporting frame to communicate between said two compartments, wherein said reinforcing wall has a top edge having a U-shape formed between said two inner walls of said casing within said communication cavity to strengthen said casing at said communication cavity.

6. The safety lighter, as recited in claim 5, wherein two sides of said top edge of said reinforcing wall are upwardly extended along said two inner walls of said casing respectively towards said lower sealing rim to increase a thickness of said casing at said communication cavity.

7. The safety lighter, as recited in claim 4, wherein said sealing arrangement further comprises two sealing rings spacedly and coaxially mounted around said gas emitting nozzle to sealedly mount said gas emitting nozzle on said supporting frame such that said two sealing rings functions as two gas leaking barriers for preventing said liquefied gas from leaking between a connection between said gas emitting nozzle and said supporting frame.

8. The safety lighter, as recited in claim 5, wherein said sealing arrangement further comprises two sealing rings spacedly and coaxially mounted around said gas emitting nozzle to sealedly mount said gas emitting nozzle on said supporting frame such that said two sealing rings functions as two gas leaking barriers for preventing said liquefied gas from leaking between a connection between said gas emitting nozzle and said supporting frame.

9. The safety lighter, as recited in claim 6, wherein said sealing arrangement further comprises two sealing rings spacedly and coaxially mounted around said gas emitting nozzle to sealedly mount said gas emitting nozzle on said supporting frame such that said two sealing rings functions as two gas leaking barriers for preventing said liquefied gas from leaking between a connection between said gas emitting nozzle and said supporting frame.

10. The safety lighter, as recited in claim 7, wherein said sealing arrangement further comprises two holding grooves spacedly provided around said gas emitting nozzle to respectively hold said two sealing rings around said gas emitting nozzle.

11. The safety lighter, as recited in claim 8, wherein said sealing arrangement further comprises two holding grooves spacedly provided around said gas emitting nozzle to respectively hold said two sealing rings around said gas emitting nozzle.

12. The safety lighter, as recited in claim 9, wherein said sealing arrangement further comprises two holding grooves spacedly provided around said gas emitting nozzle to respectively hold said two sealing rings around said gas emitting nozzle.

13. A safety lighter, comprising:

a lighter body comprising a casing defining a liquefied gas chamber for containing a predetermined volume of liquefied gas therein;

a supporting frame having an outer sealing surface sealedly attached with an inner surface of said casing, wherein said lighter body further comprises a reinforcing wall affixed between two inner walls of said casing to divide said liquefied gas chamber into two compartments, wherein said reinforcing wall is upwardly extended towards said opening portion of said casing to define a communication cavity between said reinforcing wall and said supporting frame to communicate between said two compartments, wherein said reinforcing wall has a top edge having a U-shape formed between said two inner walls of said casing within said communication cavity to strengthen said casing at said communication cavity;

a gas emitting nozzle mounted on said supporting frame to communicate with said liquefied gas chamber for emitting said gas from said liquefied gas chamber in a controlled manner;

an ignition device supported by said supporting frame for igniting said gas emitted from said gas emitting nozzle; and a sealing arrangement comprising upper and lower sealing rims spacedly and integrally provided along an opening portion of said inner surface of said casing in a continuous step-shoulders shape wherein said upper and lower sealing rims are sealedly attached with said outer sealing surface of said supporting frame to form two sealing lines along said upper and lower sealing rims respectively to sealedly mount said supporting frame on said lighter body for sealedly retaining said liquefied gas within said liquefied gas chamber.

14. The safety lighter, as recited in claim 13, wherein two sides of said top edge of said reinforcing wall are upwardly extended along said two inner walls of said casing respectively towards said lower sealing rim to increase a thickness of said casing at said communication cavity.

15. A safety lighter, comprising:

a lighter body comprising a casing defining a liquefied gas chamber for containing a predetermined volume of liquefied gas therein;

a supporting frame having an outer sealing surface sealedly attached with an inner surface of said casing, wherein said lighter body further comprises a reinforcing wall affixed between two inner walls of said casing to divide said liquefied gas chamber into two compartments, wherein said reinforcing wall is upwardly extended towards said opening portion of said casing to define a communication cavity between said reinforcing wall and said supporting frame to communicate between said two compartments, wherein said reinforcing wall has a top edge having a U-shape formed between said two inner walls of said casing within said communication cavity to strengthen said casing at said communication cavity;

a gas emitting nozzle mounted on said supporting frame to communicate with said liquefied gas chamber for emitting said gas from said liquefied gas chamber in a controlled manner;

an ignition device supported by said supporting frame for igniting said gas emitted from said gas emitting nozzle; and a sealing arrangement comprising upper and lower sealing rims spacedly and integrally provided along an opening portion of said inner surface of said casing in a continuous step-shoulders shape wherein said upper and lower sealing rims are sealedly attached with said outer sealing surface of said supporting frame to form two sealing lines along said upper and lower sealing rims respectively to sealedly mount said supporting frame on said lighter body for sealedly retaining said liquefied gas within said liquefied gas chamber, wherein each of said upper and lower sealing rims is integrally formed around said opening portion of said inner surface of said casing in said step-shoulders shape by physically reducing a thickness of said opening portion of said casing.

16. The safety lighter, as recited in claim 15, wherein two sides of said top edge of said reinforcing wall are upwardly extended along said two inner walls of said casing respectively towards said lower sealing rim to increase a thickness of said casing at said communication cavity.

* * * * *